United States Patent [19]

Oda et al.

[11] 4,444,641

[45] Apr. 24, 1984

[54] ELECTRODE

[75] Inventors: Yoshio Oda; Hiroshi Otouma; Eiji Endoh, all of Yokohama, Japan

[73] Assignee: Asahi Glass Company Ltd., Tokyo, Japan

[21] Appl. No.: 279,754

[22] Filed: Jul. 2, 1981

[30] Foreign Application Priority Data

Jul. 11, 1980 [JP] Japan ..... 55-93867

[51] Int. Cl.[3] ..... C25B 11/02; C25B 13/00

[52] U.S. Cl. ..... 204/286; 204/290 R; 204/293

[58] Field of Search ..... 204/293, 290 R, 283, 204/286

[56] References Cited

U.S. PATENT DOCUMENTS

| | | | |
|---|---|---|---|
| 1,855,497 | 4/1932 | Stuart | 204/283 X |
| 3,671,415 | 6/1972 | King et al. | 204/284 |
| 3,725,223 | 4/1973 | DeNora et al. | 204/99 |
| 4,170,536 | 10/1979 | Kawasaki et al. | 204/290 R |
| 4,248,679 | 2/1981 | Welch et al. | 204/98 |

FOREIGN PATENT DOCUMENTS

| | | |
|---|---|---|
| 216022 | 7/1961 | Austria . |
| 1326673 | 8/1973 | United Kingdom . |
| 1494586 | 12/1977 | United Kingdom . |

*Primary Examiner*—F. Edmundson

*Attorney, Agent, or Firm*—Oblon, Fisher, Spivak, McClelland & Maier

[57] ABSTRACT

An electrode comprises a thin net type sheet having 50 to 3 mesh and a wire diameter of 0.15 to 2 mm and an elastic deformation factor of up to 1 mm under load of 1 Kg/cm$^2$ which is covered with an electrode active material and a foraminous planner electrode support with which said thin net is closely brought into contact.

6 Claims, No Drawings

ELECTRODE

BACKGROUND OF THE INVENTION

1. Field of the Invention

The present invention relates to an electrode. More particularly, it relates to an electrode structure wherein an electrochemically active sheet is fixed so as easily to be attached or removed, on a foraminous planar electrode support which is fixed on a body of a large electrolytic cell by welding etc.

2. Description of the Prior Art

Anodes and cathodes are fixed by welding on a body of a large heavy electrolytic cell such as PPG-Glanol electrolytic cell known as a typical bipolar electrolytic cell for electrolyzing an aqueous solution of an alkali metal chloride to obtain an alkali metal hydroxide by using an asbestos diaphragm as a typical diaphragm process. Therefore, in order to form an electrochemically active material on the electrodes or to remove a deactivated material from the electrodes, it has been necessary to move the body of the cell in the treatment and various disadvantages have been found in the operations.

It has been proposed to reduce hydrogen overvoltage by forming an electrochemically active layer on a surface by leaching out a part of components of an alloy for a cathode with an alkaline material. However, a cathode treated by the conventional process causes disadvantages such that conditions for generating hydrogen gas such as sizes of generated hydrogen gas and residence of hydrogen gas on the surface of the cathode are not satisfactory. The reduction of hydrogen overvoltage has not been satisfactorily affected to an expected reduction of a cell voltage.

In order to improve these disadvantages, an improved individual deposition of asbestos and a control of an amount of deposition of asbestos have been studied. However, concentrations and purities of the resulting chlorine gas and an alkali metal hydroxide are highly affected by the conditions. A desired result is not expected in view of such conditions. The activated effect does not continue for a long time by one treatment for leaching out a part of the alloy. It is necessary sometimes to retreat the electrodes. Only the surface portion of the electrodes is etched by one treatment, however, the etched portions of the electrodes are increased by the repeat treatments whereby desired electrolytic characteristics and strength of the electrodes may be lost.

SUMMARY OF THE INVENTION

It is an object of the present invention to overcome said disadvantages found in the conventional processes and to form and to remove easily an electrochemically activated material and to provide an electrode having excellent characteristics such as low hydrogen overvoltage and low resistance.

The foregoing and other objects of the present invention have been attained by using a thin net type sheet which has a thickness being remarkably thinner than the conventional electrodes and has an electrochemically active material surface layer, to closely contact with a surface of a foraminous planar electrode support. The thin net type sheet has 50 to 3 mesh and a wire diameter 0.15 to 2 mm and an elastic deformation factor of up to 1 mm under load of 1 Kg/cm$^2$.

DETAILED DESCRIPTION OF THE PREFERRED EMBODIMENTS

The thin net type sheet for supporting an electrochemically active material is not limited to a net and a wire gauze but can be an expanded metal sheet or a porous sheet. The thickness is thin has a wire diameter of 0.15 to 2 mm and 50 to 3 mesh in the form of a net or to correspond them in the other net type sheet.

When the physical property of the net type sheet is out of said ranges, the rigidity is too high to closely contact with a surface of a foraminous planar electrode support having a curved surface or the strength of the wire is too low and the wire is partially cut or the operation for supporting the electrochemically active material is not easy.

The net type sheet having high elasticity is not suitable for an electrolytic cell, because it adversely affects the diaphragm. It is necessary to use the net type sheet having low elastic deformation factor especially up to 1 mm under load of 1 Kg/cm$^2$ which is an elastic deformation of a thickness of a net type sheet under load of 1 Kg/cm$^2$ in perpendicular to the surface of the sheet. The elastic deformation is measured by holding a net type sheet on a hard plate and applying a load.

The net type sheet can be made of titanium, niobium, tantalum, etc. for an anode and iron, iron alloy, stainless steel, copper, niobium, titanium, nickel, nickel alloy (Nichrom, Inconel, Monel etc.) etc. for a cathode.

The electrochemically active material supported on the net type sheet in the present invention can be one or more of Ru, Pt, Pd, Ir, Ph or Co or an oxide thereof for an anode: and one or more of Ni, Co, Fe, Ru, Re, Pt, Ph, Pd, Os, Ir or V for a cathode.

In the case of the cathode, it is preferable to codeposit Raney nickel, Raney cobalt or Raney silver particles with said metal on the net type sheet. When such cathode is used, a low hydrogen overvoltage is given and can be maintained for a long time.

It is also possible to incorporate an additive such as sulfur, carbon, titanium, selenium, tungsten, boron, phosphorus, zirconium and fluorinated polymer into the electrochemically active material as desired.

The process for supporting the electrochemically active material on the net type sheet is not limited. It is possible to employ a conventional process such as an electric plating process, a chemical plating process, a dipping process, a coating process, a spraying process and a melt injection process.

When the electrochemically active material is formed by leaching out a part of an alloy as a treated cathode, the net type sheet is prepared by a desired alloy and the active material is formed by an alkali etching process. Such etching process is also included for the support of the electrochemically active material on the net type sheet in the present invention.

The thin net type sheet supporting an electrochemically active material can be closely brought into contact with a surface of a foraminous planar electrode support, for example, an electrode or an electrode foraminous planar electrode support (both of them are referred to as a foraminous planar electrode support) which is fixed in a body of a large heavy electrolytic cell such as PPG-Glanol cell. The net type sheet can be formed in the same shape as the foraminous planar electrode support or in a bag shape to cover the sheet on the foraminous planar electrode support. If necessary, the net type sheet can be held on the foraminous planar electrode support by welding or with bolts and nuts.

The electrode of the present invention can be an anode or a cathode and can be used for an electrolysis such as an electrolysis of various aqueous solution and an electrodialysis. It is especially suitable for a diaphragm process for a production of an alkali metal hydroxide by an electrolysis of an aqueous solution of an alkali metal chloride. The diaphragm used for the diaphragm process can be asbestos diaphragm, a diaphragm of asbestos reinforced with a fluorinated resin such as polytetrafluoroethylene and a cation exchange membrane of a fluorinated polymer having ion exchange groups such as carboxylic acid group, sulfonic acid groups, phosphoric acid groups and phenolic hydroxyl groups. When asbestos or an asbestos reinforced with a fluorinated resin is used for the diaphragm, and the cathode of the present invention is used, a diffusion of the generated gas is remarkably improved in comparison with the use of the cathode prepared by treating a surface of foraminous planar electrode support for lower hydrogen overvoltage. Therefore, an amount of asbestos or the fluorinated resin can be controlled in a broad range without adverse effect for a concentration and a purity of the resulting alkali metal hydroxide or chlorine. Thus, a desired hydrogen overvoltage lowering effect can be imparted for the cell voltage.

When the electrode of the present invention is used for an ion membrane type electrolytic cell, it is not always necessary to closely contact the membrane with the electrode. It is preferable to place the membrane near the electrode.

When the electrode of the present invention is reactivated, only the net type sheet supporting the active material is taken out and can be treated for the reactivation. It is unnecessary to move the heavy foraminous planar electrode support or the cell.

EXAMPLE 1

A nickel wire gauze having 10 mesh and a wire diameter of 0.5 mm and a size of 5×30 cm was treated by the following plating process in a Raney nickel dispersion.

Into a bath of nickel chloride ($NiCl_2$-$6H_2O$: 300 g./liter and $H_3BO_3$: 40 g./liter), Raney nickel powder (Ni: 50 wt. % and Al: 50 wt. %) (200 mesh pass) was added at a concentration of 10 g./liter and the dispersion was stirred. A dispersion plating was carried out by using said nickel wire gauze as a cathode and a nickel plate as an anode at 50° C. at a current density of 2 A/dm$^2$ for 1 hour. On the surface of the wire gauze, Raney nickel particles were deposited in an amount of 3 g./dm$^2$ together with nickel. A hydrogen overvoltage of the electrode measured in an aqueous solution of 10.4% NaOH and 16% NaCl. at 90° C. at a current density of 20 A/dm$^2$ was 0.10 V.

The Raney nickel deposited nickel wire gauze was closely brought into contact with an untreated net iron cathode with spot welding at many positions. On the nickel wire gauze asbestos fiber was deposited at an amount of 17 g./dm$^2$ and was dried in air for 2 days to prepare a small asbestos diaphragm electrolytic cell and the characteristics were evaluated under the following electrolytic condition.

Anode: $RuO_2$ coated titanium electrode
Anolyte: 5.2 N-NaCl. aq. sol.
Catholyte: Aqueous solution of 10% NaOH and 16% NaCl.
Electrolytic temperature: 90° C.
Current density: 20 A/dm$^2$.

As a result, the cell voltage was 3.07 V which was lower than that of the iron cathode, by 0.18 V. On the other hand, the hydrogen overvoltage of the iron cathode was higher than that of said cathode for 0.18 V. The reduction of the overvoltage by 0.18 V corresponds to the reduction of the cell voltage by 0.18 V. The characteristics of the lower overvoltage cathode is highly imparted.

EXAMPLE 2

Raney nickel deposited nickel cathode was prepared by the process of Example 1 and was equipped with a small asbestos diaphragm electrolytic cell. Instead of asbestos fiber, a slurry for deposition was prepared by incorporating 85 wt. parts of asbestos fiber, 15 wt. parts of ethylene-tetrafluroethylene copolymer fiber (46 wt. % of ethylene and 53 mol % of tetrafluoroethylene and 1 mol % of hexafluoropropylene) having a diameter of 30μ and a length of 12 mm in an aqueous solution containing 135 g./liter of NaOH, 190 g./liter of NaCl and 0.1 g./liter of nonionic surfactant (Triton X-100 Rhom & Haas). The mixed fiber was deposited at an amount of 17 g./dm$^2$ as Example 1. The net type cathode with the deposited diaphragm was heated in an electric furnace at 150° C. for 1 hour and at 300° C. for 50 minutes to bake it.

In accordance with the process of Example 1, the electrode characteristics were measured. A cell voltage was 2.87 V which is lower than that of the iron cathode by 0.18 V.

EXAMPLE 3

A wire gauze made of SUS-304 having 20 mesh and a wire diameter of 0.2 mm and a size of 5 cm×5 cm was treated in 52% NaOH aqueous solution at 150° C. for 50 hours for etching. After the etching, a hydrogen overvoltage of the wire gauze measured in 35% NaOH aq. sol. at 90° C. at a current density of 20 A/dm$^2$ was 0.11 V. The etched wire gauze was closely brought into contact with an expanded metal made of SUS-304 (meshes of 20 mm×10 mm: thickness of 2 mm) by spot welding, and was used as a cathode for an electrolysis of sodium chloride in a cation exchange membrane process. The condition for the electrolysis is as follows:

Cation exchange membrane: Copolymer of polytetrafluoroethylene and $CF_2{=}CFO(CF_2)_3.COOCH_3$ Ion exchange capacity of 1.45 meq/g. dry polymer: thickness of 220μ.
Anode: Ruthenium oxide coated titanium.
Anolyte: 4 N-NaCl aq. sol.
Catholyte: 35% NaOH aq. sol.
Electrolytic temperature: 90° C.
Current density: 20 A/dm$^2$.

A cathode potential was measured and a hydrogen overvoltage calculated from it was 0.11 V. A cell voltage was 3.07 V which was lower then that of the untreated expanded metal cathode of 3.30 V by 0.23 V. A hydrogen overvoltage of the untreated expanded metal cathode was 0.34 V which was higher than that of an alkali treated wire gauze electrode by 0.23 V. The electrolysis was continued for about 100 days in the same condition. The cell voltage was kept in stable in a range of 3.06–3.08 V. After the test, the coated wire gauze was easily peeled off from the expanded metal.

EXAMPLE 4

Ruthenium oxide layer was formed on a wire gauze made of titanium having 20 mesh and a wire diameter of 2 mm and a size of 5×30 cm. This was used instead of the anode of Example 2. An aqueous solution of 0.6 mol/liter of Ru component was prepared by dissolving Ru in 20% HCl aq. sol. A wire gauze made of titanium was dipped into the aqueous solution and was baked at 450° C. for 5 minutes in air. This was repeated 10 times and the product was baked at 500° C. for 3 hours in air to obtain a wire gauze of titanium coated with ruthenium oxide having a thickness of about 2μ. An expanded metal made of titanium was used as a foraminous planner electrode support and the resulting wire gauze was welded on the foraminous planar electrode support. In accordance with the process of Example 2, the electrolysis of soduim chloride was carried out. A cell voltage was 2.87 V.

EXAMPLE 5

A wire gauze made of nickel having 40 mesh and a wire diameter of 0.2 mm and a size of 5×30 cm was coated by the following Raney nickel dispersion plating process.

Into a bath of nickel chloride ($NiCl_2$-$6H_2O$: 300 g./liter and $H_3BO_3$: 40 g./liter), Raney nickel powder (Ni: 50 wt. % and Al: 50 wt. %) (200 mesh pass) was added at a concentration of 10 g./liter and the dispersion was stirred. The dispersion plating was carried out by using said nickel wire gauze as a cathode and a nickel plate as an anode at 50° C. at a current density of 2 A/dm$^2$ for 1 hour. On the surface of the wire gauze, Raney nickel particles were deposited at an amount of 2.7 g./dm$^2$ together with nickel.

A hydrogen overvoltage of an electrode measured in an aqueous solution of 10.4% NaOH and 16% NaCl at 90° C. at a current density of 20 A/dm$^2$ was 0.10 V.

The electrode was equipped with a small asbestos diaphragm electrolytic cell and the characteristics were evaluated under the following electrolytic condition. The Raney nickel deposited nickel wire gauze was closely brought into contact with an untreated net iron cathode with spot welding at many positions. On the nickel wire gauze, asbestos fiber was deposited at an amount of 17 g./dm$^2$ and was dried in air for 2 days. The characteristics were evaluated under the following electrolytic condition.

Anode: $RuO_2$ coated titanium electrode
Anolyte: 5.2 N-NaCl aq. sol.
Catholyte: Aqueous solution of 10% NaOH and 16% NaCl
Electrolytic temperature: 90° C.
Current density: 20 A/dm$^2$.

As a result, the cell voltage was 3.07 V which was lower than that of the iron cathode by 0.18 V.

EXAMPLE 6

A wire gauze made of SUS-304 having 40 mesh and a wire diameter of 0.15 mesh and a wire diameter of 0.15 mm and a size of 5 cm×30 cm was treated in 52% NaOH aqueous solution at 150° C. for 50 hours for etching. After the etching, a hydrogen overvoltage of the wire gauze measured in an aqueous solution of 10.4% NaOH and 16% NaCl at 90° C. at a current density of 20 A/dm$^2$ was 0.11 V.

The etched wire gauze was closely brought into contact with a net iron cathode by spot welding and asbestos fiber was deposited at an amount of 17 g./dm$^2$ and was dried in air for 2 days. The electrode was equipped with a small asbestos diaphragm electrolytic cell and an electrolysis was carried out the condition for the electrolysis is as follows.

Anode: Ruthenium oxide coated titanium
Anolyte: 5.2 N-NaCl aq. sol.
Catholyte: Aqueous solution of 10% NaOH and 16% NaCl
Electrolytic temperature: 90° C.
Current density: 20 A/dm$^2$.

As a result, a cell voltage was 3.08 V which was lower than that of the iron cathode by 0.17 V.

EXAMPLE 7

The electrolysis of Example 1 except that an electrode size is $1^m \times 1^m$ and 5 electrode sheets are used, was continued for 1.5 years. The cell voltage was raised from 3.07 V to 3.12 V. The Raney nickel electrodeposited nickel wire gauze was separated from the iron cathode. The process for separation of the wire gauze was easily attained only by disconnecting welded portions.

The wire gauze was treated to deposit Raney nickel particles with nickel by the process of Example 1. The codeposition on wire gauzes was easily carried out in a small plating bath.

On the other hand, the iron cathode was prepared by coelectrodeposition of Raney nickel of Example 1. In the operation, a large plating bath, many auxiliary instruments and a large amount of plating solution are needed. An electrolysis was carried out under the condition same as Example 1. The cell voltage rose from 3.17 V to 3.22 V during 1.5 years.

The cathode was treated for the purpose of a reactivation of the cathode like this example. In the treatment, a large vessel for the cathode fixed on the cathode frames was needed. In order to retreat the cathode, large auxiliary instruments are also needed. The operation for the reactivation was remarkably complicated.

We claim:

1. An electrode consisting essentially of a thin net type sheet having 50 to 3 mesh and a wire diameter of 0.15 to 2 mm and an elastic deformation factor of up to 1 mm under a load of 1 Kg/cm$^2$ which is covered with an electrochemically active material and said mesh electrode is supported by a foraminous planar electrode support having a higher overvoltage than that of said thin net type sheet with which said thin net is closely brought into contact.

2. The electrode according to claim 1 wherein said thin net type sheet is a wire gauze or a gauze expanded metal.

3. The electrode according to claim 1 or 2 wherein said thin net is made of titanium, niobium, tantalum, iron, iron alloy, stainless steel, copper, nickel or nickel alloy.

4. The electrode according to claim 1 wherein said foraminous planar electrode support is fixed on a body of an electrolytic cell.

5. The electrode according to claim 1 wherein said electrode is used in an electrolytic cell equipped with a cation exchange membrane, an asbestos diaphragm or a composite of asbestos diaphragm and a resin.

6. The electrode according to claim 1 wherein said thin net type sheet is coated with Raney nickel particles bonded with nickel.

* * * * *